US005681147A

United States Patent [19]

Yung-Chung

[11] Patent Number: 5,681,147

[45] Date of Patent: Oct. 28, 1997

[54] CEILING FAN MOTOR HOUSING ASSEMBLY

[76] Inventor: Huang Yung-Chung, 3F, No. 36-4, Shu Hsin Road, Shu Lin Chen, Taipei Hsien, Taiwan

[21] Appl. No.: 693,031

[22] Filed: Aug. 6, 1996

[51] Int. Cl.[6] ..... F04D 29/52; F04D 29/64

[52] U.S. Cl. ..... 416/244 R; 416/5; 416/93 R

[58] Field of Search ..... 416/5, 93 R, 170 R, 416/244 R; 417/360; 362/96, 122, 294, 374, 375; 403/11, 274, 282; 248/342–344; 310/89

[56] References Cited

U.S. PATENT DOCUMENTS

| | | | |
|---|---|---|---|
| D. 271,330 | 11/1983 | Yung | D23/411 |
| 2,974,878 | 3/1961 | Norling | 248/343 |
| 4,863,346 | 9/1989 | Lin | 416/5 |
| 4,878,806 | 11/1989 | Markwardt | 416/5 |
| 5,439,350 | 8/1995 | Yu | 416/5 |
| 5,503,524 | 4/1996 | Yu | 416/5 |

*Primary Examiner*—Christopher Verdier
*Attorney, Agent, or Firm*—Browdy and Neimark

[57] ABSTRACT

A ceiling fan motor housing assembly including a cup-like motor holder frame having an open top, a top cover shell covered on the cup-like motor holder frame over its open top, the top cover having a downward flange around the border fitted into the cup-like motor holder frame, and a bottom cover shell fastened to the cup-like motor holder frame and the top cover by screws and covered around the cup-like motor holder frame, having a plurality of ornaments on the outside.

6 Claims, 7 Drawing Sheets

CEILING FAN MOTOR HOUSING ASSEMBLY

BACKGROUND OF THE INVENTION

The present invention relates to ceiling fans, and relates more particularly to the motor housing assembly of a ceiling fan which has a replaceable decorative bottom cover shell that can be replaced to change the ornamental pattern.

Regular ceiling fans commonly have a motor housing adapted for holding the fan motor. In order to attract people, the motor housing may be embossed or decorated with ornaments. However, when a conventional motor housing is made with ornaments, the ornamental pattern can no longer be changed. If it is desired to change the ornamental pattern of a conventional motor housing it must be entirely replaced.

SUMMARY OF THE INVENTION

The present invention has been accomplished under the circumstances in view. It is one object of the present invention to provide a ceiling fan motor housing assembly which has a replaceable decorative bottom cover shell that can be replaced to change the ornamental pattern. It is another object of the present invention to provide a ceiling fan motor housing assembly which is detachable, and inexpensive.

According to one embodiment of the present invention, the ceiling fan motor housing assembly comprises a cup-like motor holder frame having an open top, a top cover shell covered on the cup-like motor holder frame over its open top, the top cover having a downward flange around the border fitted into the cup-like motor holder frame, and a bottom cover shell fastened to the cup-like motor holder frame and the top cover by screws and covered around the cup-like motor holder frame, having a plurality of ornaments on the outside. The top cover shell, the cup-like motor holder frame, and the bottom cover shell have respective through holes connected together by screws and nuts. By removing the nuts from the screws, the bottom cover shell can be disconnected from the cup-like motor holder frame and the top cover shell for a replacement to change the ornamental pattern of the ceiling fan motor housing assembly. In a second embodiment of the present invention, the ceiling fan motor housing assembly is comprised of a cup-like motor holder frame having an open top and a plurality of outside mounting grooves, a top cover shell covered on the cup-like motor holder frame over its open top, and a plurality of ornamental panels respectively mounted in the mounting grooves of the cup-like motor holder frame and covered on the outside of the cup-like motor holder frame. The ornamental panels can be detached from the cup-like motor holder frame for a replacement to change the ornamental pattern of the ceiling fan motor housing assembly.

DETAILED DESCRIPTION OF THE PREFERRED EMBODIMENT

Figure 1:
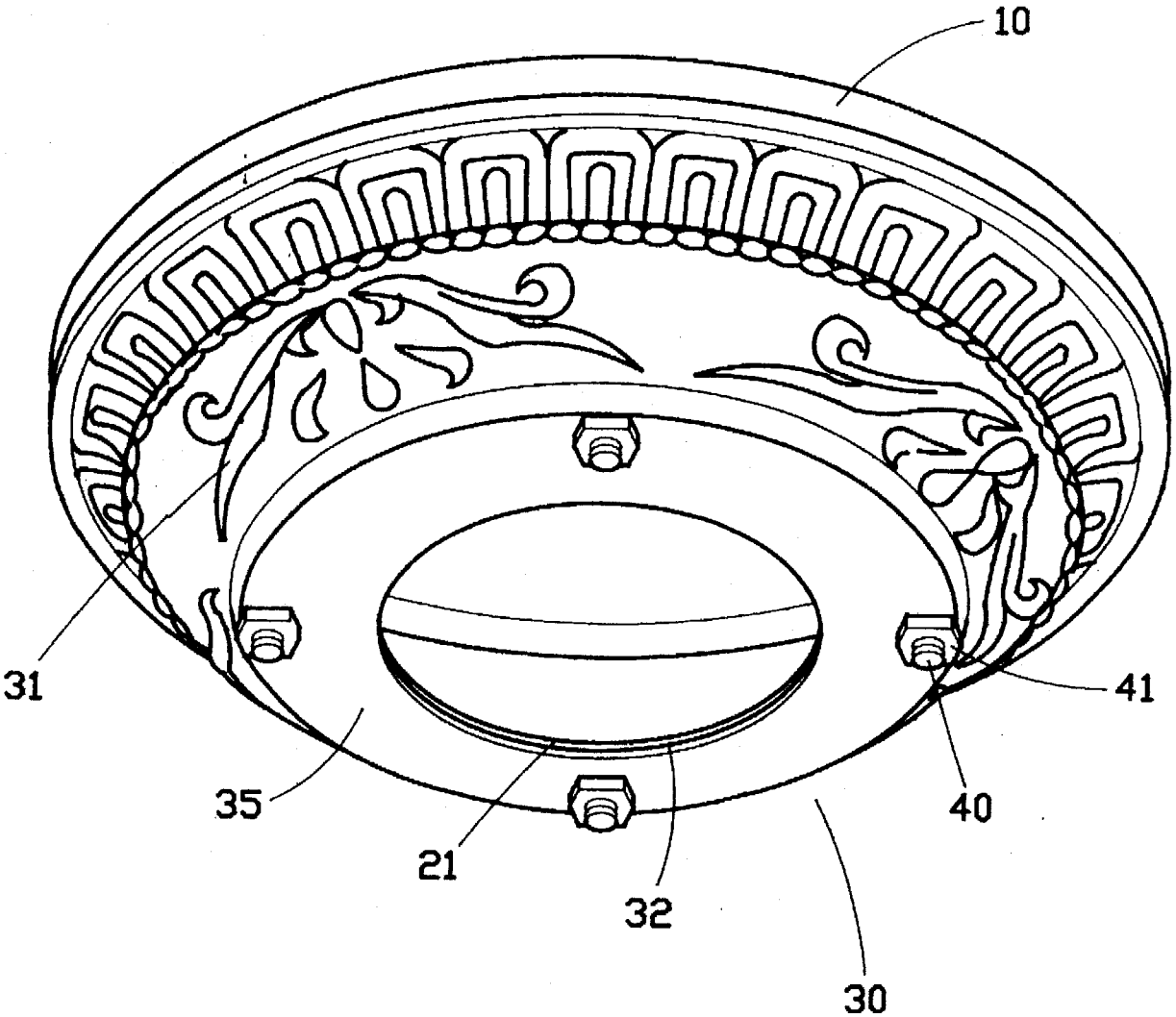
FIG. 1 is an elevational view of a motor housing assembly according to the present invention.
Figure 2:
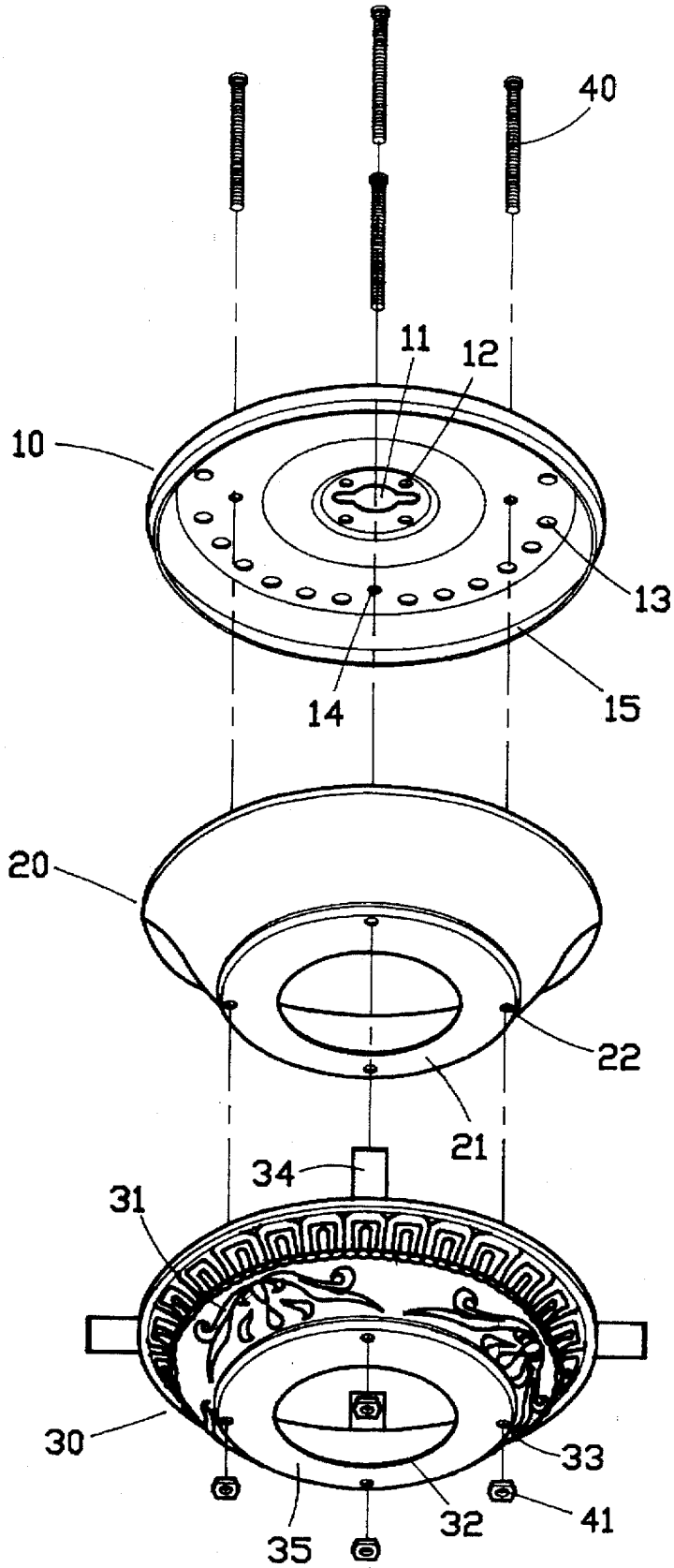
FIG. 2 is an exploded view of the motor housing assembly shown in FIG. 1.
Figure 3:
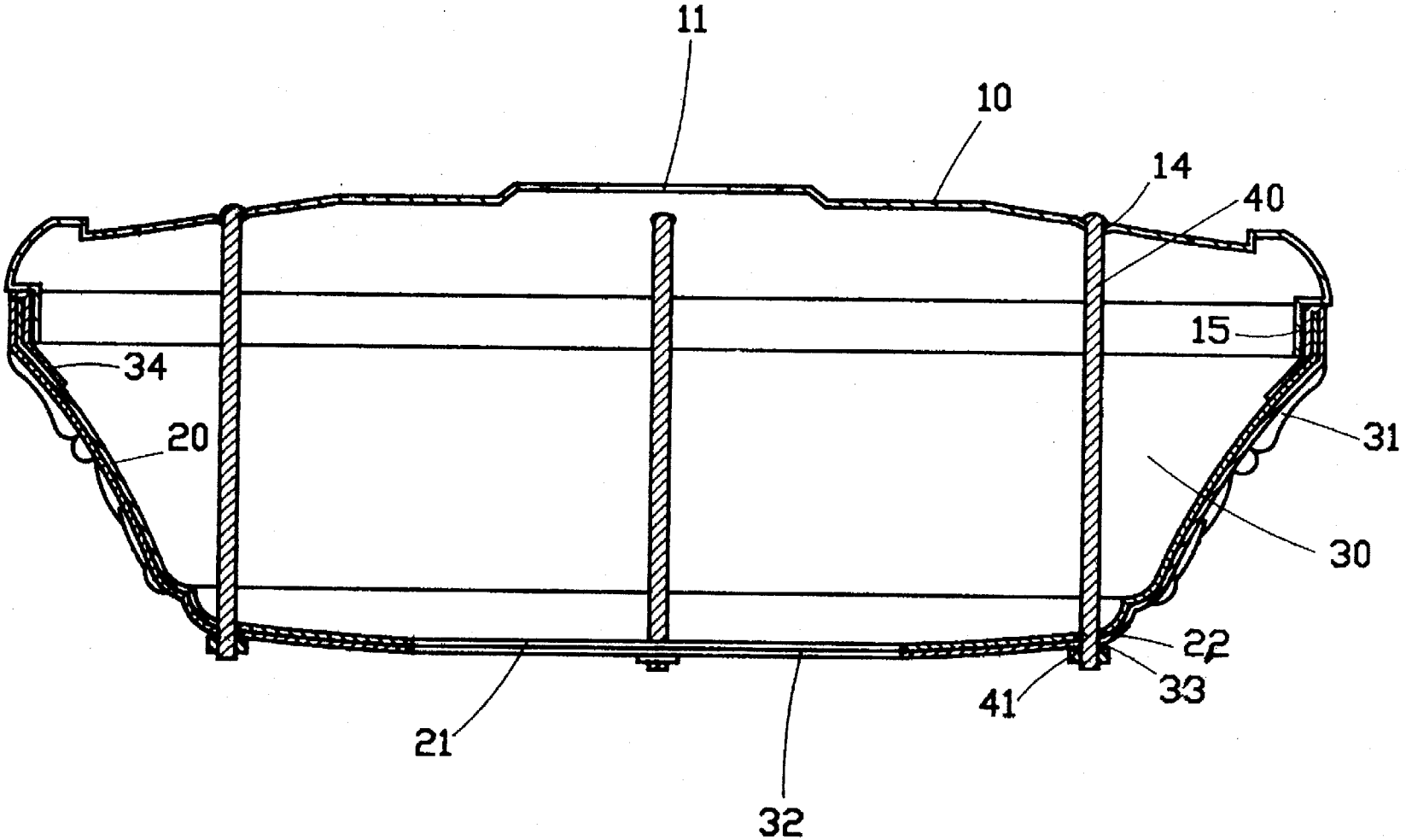
FIG. 3 is sectional plane view of the motor housing assembly shown in FIG. 1.

Referring to FIGS. 1, 2, and 3, a motor housing assembly in accordance with one embodiment of the present invention is generally comprised of a top cover shell 10, a cup-like motor holder frame 20, and a bottom cover shell 30. The top cover shell 10 is a rounded shell having a center opening 11 and a plurality of mounting holes 12 around the center opening 11 for installation in the ceiling, a plurality of air vents 13, a plurality of through holes 14 for connection to the cup-like motor holder frame 20 and the bottom cover shell 30, and a downward coupling flange 15 around the border. The cup-like motor holder frame 20 has a circular bottom center hole 21, and a plurality of through holes 22 spaced around the circular bottom center hole 21 corresponding to the through holes 14 of the top cover shell 10. The bottom cover shell 30 fits over the bottom side of the cup-like motor holder frame 21 and is fastened to the top cover shell 10 to hold the cup-like motor holder frame 20 on the inside. The bottom cover shell 30 is preferably made from light or flexible material, having ornaments 31 on the outside, a bottom center hole 32 at the center of the bottom side 35 thereof corresponding to the bottom center hole 21 of the cup-like motor holder frame 20, a plurality of through holes 33 spaced around the bottom center hole 32 corresponding to the through holes 22 of the cup-like motor holder frame 20, and a plurality of bendable locating strips 34 equiangularly spaced around the border at the top.

During the assembly process, the bottom cover shell 30 is covered over the outside wall of the cup-like motor holder frame 20, then the bendable locating strips 34 are respectively bent inwards and attached to the inside wall of the cup-like motor holder frame 20 to hold down the cup-like motor holder frame 20, and then the top cover shell 10 covers on the cup-like motor holder frame 20 and the bottom cover shell 30 by fitting the downward coupling flange 15 into the inside of the cup-like motor holder frame 20, permitting the deformed locating strips 34 to be firmly retained between the downward coupling flange 15 of the top cover shell 10 and the inside wall of the cup-like motor holder frame 20, and then a plurality of screws 40 are respectively inserted through the through holes 14 of the top cover shell 10 and the through holes 22 of the cup-like motor holder frame 20 and the through holes 33 of the bottom cover shell 30 and then screwed up with respective nuts 41 to secure the top cover shell 10, the cup-like motor holder frame 20, and the bottom cover shell 30 together. Through the center opening 11 and mounting holes 12 of the top cover shell 10, the motor housing assembly can be fastened to the ceiling. Before the top cover shell 10 is fastened to the cup-like motor holder frame 20 and the bottom cover shell 30, the fan motor (not shown) is mounted within the cup-like motor holder frame 20. Through the bottom center hole 32 of the bottom cover shell 30 and the bottom center hole 21 of the cup-like motor holder frame 20, the coupling tube of the fan blade and lamp assembly (not shown) is inserted to the inside of the motor housing assembly and connected to the fan motor. Because the motor housing assembly is detachable, the bottom cover shell 30 can be disconnected from the cup-like motor holder frame 20 and the top cover shell 10 for a replacement.

Figure 7:
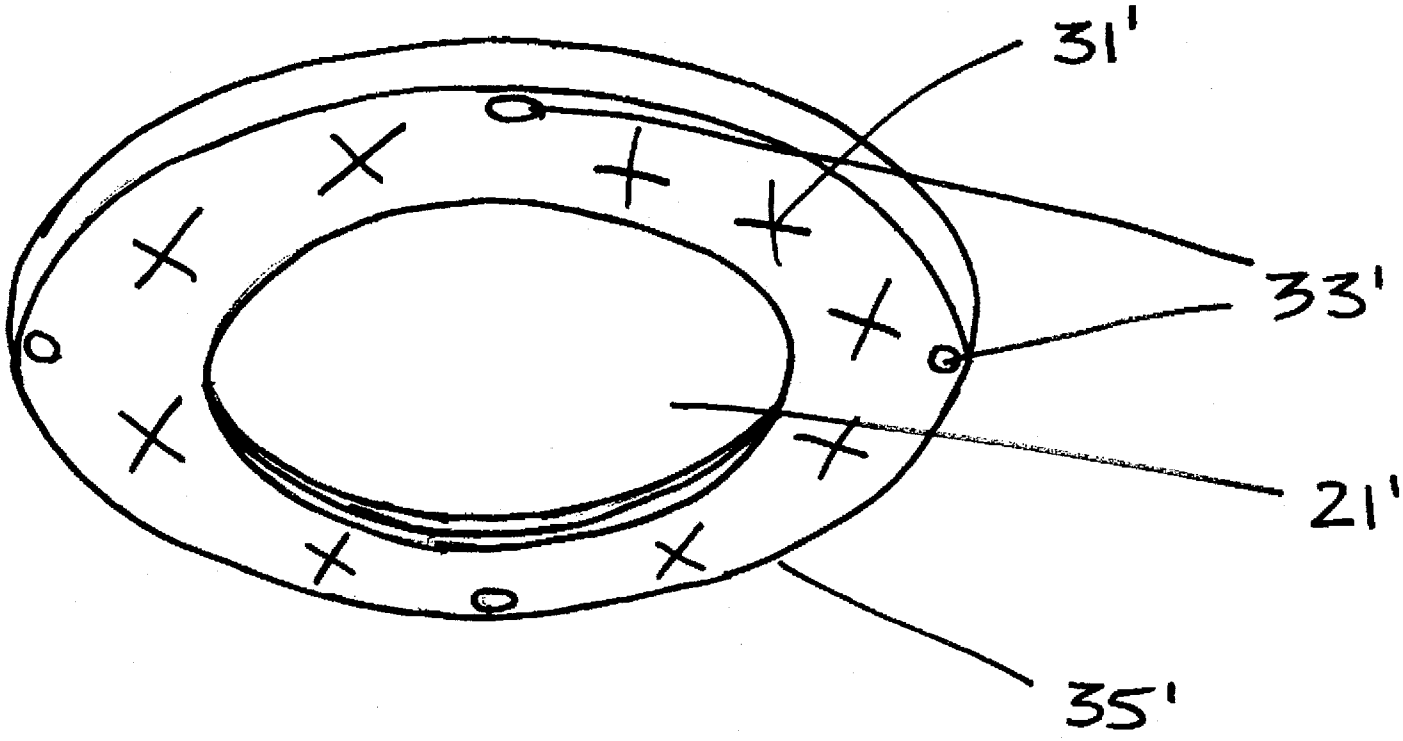
FIG. 7 is an alternative embodiment of the invention according to FIG. 1.

In the embodiment shown in FIG. 2, the ornaments 31 are made on the peripheral wall of the bottom cover shell 30. Alternatively, the ornaments 31 can be made on the bottom side 35, or both the bottom side 35 and the peripheral wall. Furthermore, the bottom side 35 of the bottom cover shell 30 may be made detachable. Such a detachable bottom 35' with ornaments 31' bottom center hole 21' and through holes 33' which holes 33' correspond to through holes 33 of the bottom cover shell 30 is shown in FIG. 7. Several bottom cover shells with different ornaments and different colors may be attached together and secured to the cup-like motor holder frame 20 and the top cover shell 10 so that the user can change the ornamental pattern of the motor housing assembly.

Figure 4:
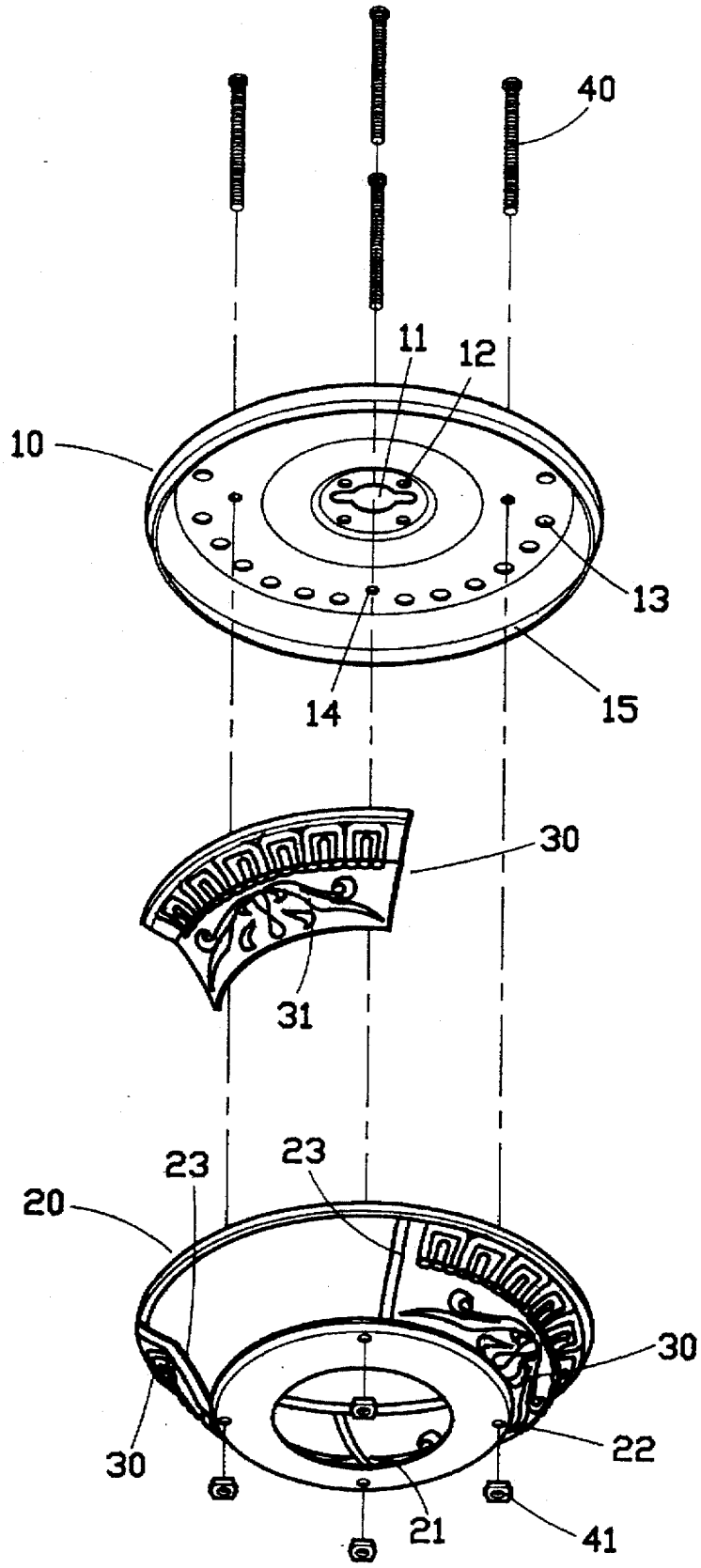
FIG. 4 is an exploded view of an alternate form of the motor housing assembly according to the present invention.
Figure 5:
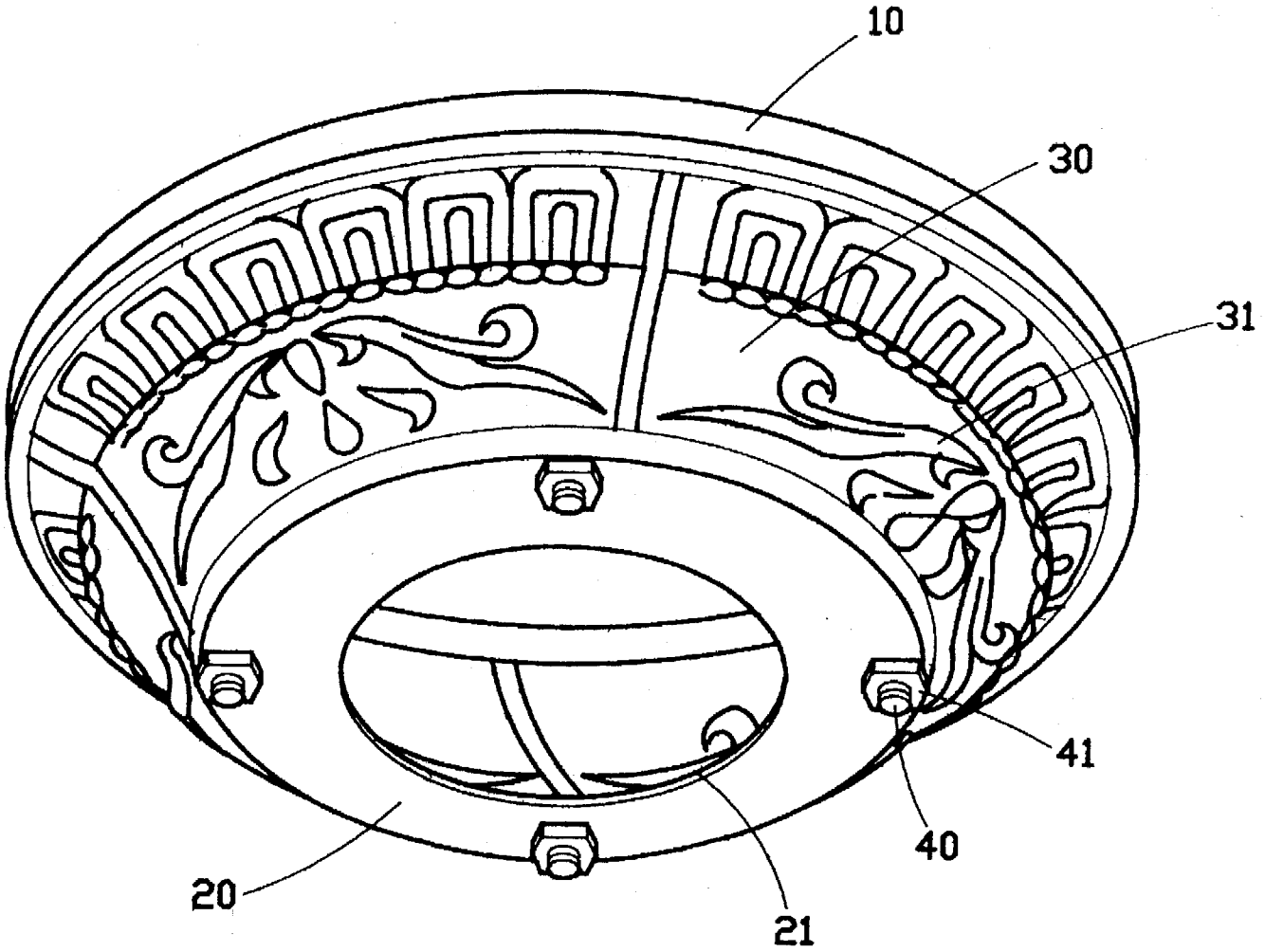
FIG. 5 is an elevational view of the motor housing assembly shown in FIG. 4.
Figure 6:
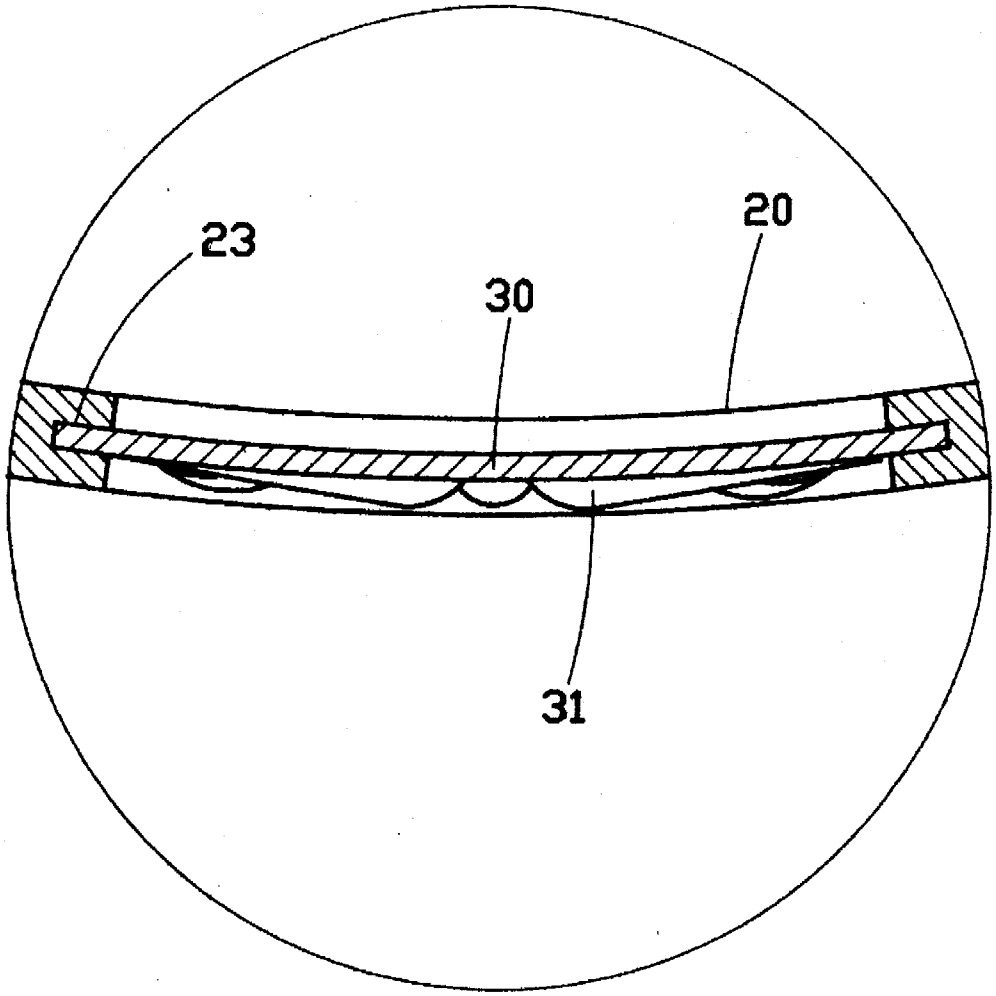
FIG. 6 is a sectional plane view of a part of FIG. 5, showing the installation of an ornamental panel in the cup-like motor holder frame.

FIGS. 4, 5, and 6 show an alternate form of the present invention. According to this alternate form, the motor housing assembly comprises a cup-like motor holder frame 20, a top cover shell 10 covered on the cup-like motor holder frame 20, and a plurality of ornamental panels 50 mounted around the outside wall of the cup-like motor holder frame 20. This alternate form eliminates the aforesaid bottom cover shell 30. The ornamental panels 50 are preferably made from light or flexible material, having a respective ornament 51 on the outside. The cup-like motor holder frame 20 has ribs 24 with mounting grooves 23 spaced around the outside wall for the positioning of the ornamental panels 50. Any mounting methods may be employed to position the ornamental panels 50 to the cup-like motor holder frame 20. For example, the ornamental panels 50 can be fastened to the cup-like motor holder frame 20 by fastening elements, or directly adhered to the cup-like motor holder frame 20 by an adhesive.

While only two alternate forms of the present invention have been shown and described, it will be understood that various modifications and changes could be made thereunto without departing from the spirit and scope of the invention disclosed. For example, the top cover shell 10, the cup-like motor holder frame 20, and the bottom cover shell 30 may be made having a polygonal profile.

The invention claimed is:

1. A ceiling fan motor housing assembly comprising:

a cup-like motor holder frame having an open top;

a top cover shell covering said cup-like motor holder frame over its open top, said top cover having a downward flange around a border fitted into said cup-like motor holder frame;

a bottom cover shell fastened to said cup-like motor holder frame and said top cover by screws and said bottom cover shell covering said cup-like motor holder frame, said bottom cover shell having a plurality of ornaments on the outside, a plurality of bendable locating strips spaced around a border at a top of said bottom cover shell, said locating strips being bent inwards and attached to the inside of said cup-like motor holder frame to hold said cup-like motor holder frame in place.

2. The ceiling fan motor housing assembly of claim 1 wherein said bottom cover shell has a detachable bottom plate.

3. The ceiling fan motor housing assembly of claim 2 wherein said detachable bottom plate is decorated with ornaments.

4. A ceiling fan motor housing assembly comprising:

a cup-like motor holder frame having an open top, and mounting ribs, said mounting ribs having mounting grooves spaced apart on an outside periphery of said cup-like motor holder frame;

a top cover shell covering said cup-like motor holder frame over its open top; and a plurality of ornamental panels respectively mounted in the mounting grooves of said mounting ribs on said cup-like motor holder frame, said plurality of ornamental panels covering the periphery of an outside of said cup-like motor holder frame.

5. The ceiling fan motor housing assembly of claim 4 wherein said ornamental panels are fastened to said cup-like motor holder frame by an adhesive.

6. A ceiling fan motor housing assembly comprising:

a cup-like motor holder frame having an open top;

a top cover shell covering said cup-like motor holder frame over its open top, said top cover having a downward flange around a border fitted into said cup-like motor holder frame; and a bottom cover shell fastened to said cup-like motor holder frame and said top cover by screws which respectively pass through aligned through holes on said bottom cover shell, said cup-like motor holder and said top cover, said bottom cover shell covering an entire periphery of said cup-like motor holder frame, a plurality of ornaments on an outside periphery of said bottom cover shell, wherein said bottom cover shell has a detachable bottom plate, wherein said detachable bottom plate is decorated with ornaments.

* * * * *